US007588060B2

(12) United States Patent
Ballard

(10) Patent No.: US 7,588,060 B2
(45) Date of Patent: Sep. 15, 2009

(54) APPARATUS, SYSTEM, AND MEANS FOR A MODULAR BACKPRESSURE SENSOR

(75) Inventor: Jay Arthur Ballard, Mapleton, UT (US)

(73) Assignee: Flomax International, Inc., Springville, UT (US)

( * ) Notice: Subject to any disclaimer, the term of this patent is extended or adjusted under 35 U.S.C. 154(b) by 590 days.

(21) Appl. No.: 11/231,606

(22) Filed: Sep. 21, 2005

(65) Prior Publication Data

US 2007/0062601 A1 Mar. 22, 2007

(51) Int. Cl.
*B67C 3/00* (2006.01)
*B05B 1/30* (2006.01)

(52) U.S. Cl. ..... 141/226; 141/192; 141/206; 141/301; 239/533.1; 239/579

(58) Field of Classification Search ..... 141/192, 141/206, 301, 302, 348–356; 239/533.1, 239/569, 578, 579, 583
See application file for complete search history.

(56) References Cited

U.S. PATENT DOCUMENTS

| | | | | |
|---|---|---|---|---|
| 3,208,486 | A * | 9/1965 | Fromm | 141/208 |
| 3,662,793 | A * | 5/1972 | Calisher et al. | 141/198 |
| 3,674,061 | A * | 7/1972 | Calisher et al. | 141/198 |
| 4,567,924 | A | 2/1986 | Brown | 141/207 |
| 4,638,842 | A | 1/1987 | Hawley et al. | 141/302 |
| 4,794,960 | A | 1/1989 | Hawley et al. | 141/384 |
| 4,919,174 | A * | 4/1990 | Warland | 141/384 |
| 5,070,732 | A | 12/1991 | Duncan et al. | 73/431 |
| 6,131,623 | A | 10/2000 | Nusbaumer et al. | 141/206 |
| 6,168,168 | B1 | 1/2001 | Brown | 277/637 |
| 6,253,803 | B1 | 7/2001 | Nusbaumer et al. | 141/94 |
| 6,405,768 | B1 | 6/2002 | McClaran | 141/346 |
| 6,622,760 | B2 * | 9/2003 | Peattie | 141/224 |
| 6,705,550 | B2 * | 3/2004 | Bell | 239/533.1 |
| 2003/0015249 | A1 | 1/2003 | Jursich | 141/4 |
| 2005/0056415 | A1 | 3/2005 | Zillinger | 166/66 |

* cited by examiner

*Primary Examiner*—Timothy L Maust
(74) *Attorney, Agent, or Firm*—Kunzler & McKenzie

(57) ABSTRACT

An apparatus, system, and means are disclosed for a modular backpressure sensor configured for use with a fluid delivery nozzle. The modular backpressure sensor may be installed and removed using simple tools and may optionally include an activator handle attachment. The system may optionally include a protective end plug for the fluid delivery nozzle.

26 Claims, 6 Drawing Sheets

APPARATUS, SYSTEM, AND MEANS FOR A MODULAR BACKPRESSURE SENSOR

BACKGROUND OF THE INVENTION

1. Field of the Invention

This invention relates to a removable pressure calibration module installed in a pressure sensitive fluid delivery nozzle. One embodiment relates to a system for fueling large vehicles.

2. Description of the Related Art

Large construction and mining vehicles are often equipped with a fueling system that allows the fuel tank to be filled from the bottom. This enables the fueling of the vehicle to take place from ground level as many of the vehicles of this type are extremely large. There are two types of fueling systems that allow fueling from the bottom of the tank. They both incorporate three common components: 1) a fueling nozzle that senses a pressure change in order to shut off, 2) a fueling receiver that is permanently attached to the fuel tank to which the nozzle attaches, and 3) a fuel vent that can sense when the fuel tank is filled and provide a pressure change that can be sensed by the nozzle. One system uses a vent that closes an exhaust port when the fuel tank is full allowing the tank itself to become pressurized by the incoming fuel. The fuel nozzle senses this pressure and shuts off at a pre-determined pressure level. The second type of system uses a vent that is attached by one or more hoses to the fuel receiver. When the tank is full, the vent provides a pressure change to one or more of the hoses which causes a valve in the fuel receiver to change position which in turn causes the fuel nozzle to shut off. In some systems, the same fuel nozzle can be used in conjunction with different combinations of vents and receivers to provide either a pressure operated system (tank is pressurized) or a non-pressurized system (the tank is not pressurized).

Most fuel nozzles of this type incorporate a pressure sensing device. Most fuel nozzles, in current use, incorporate either a spring biased piston or diaphragm to sense the change in back pressure of the fuel flowing through the nozzle. The change in back pressure causes the nozzle to shut off when the pressure reaches a pre-set pressure. The pressure is typically calibrated and pre-set by mounting the entire nozzle on specialized equipment in a repair shop. Moreover, the nature of its function subjects the pressure sensing component to a significantly greater rate of wear than the other parts of the nozzle.

Due to the extreme conditions of use, the nozzles typically require frequent rebuilding—often after every few months or even after every few weeks of operation. The entire nozzle must be returned to a rebuild center to be completely disassembled, reassembled with certain potentially new components, and tested as a unit on a fairly complex test stand. Only a few fully equipped rebuild sites exist. This requires that complete back up sets of these expensive nozzles be kept on hand at the mining and construction sites for use while a first set of nozzles is being rebuilt.

Additionally, some fueling systems physically restrict the diameter of the delivery end of the fueling nozzle. At one time, most nozzles incorporated a rubber bumper on the end of the fuel nozzle to provide physical protection from incidental damage when the nozzle was not in use. Because of the new diameter restrictions, many users remove the rubber bumpers in order to fit on the newer fuel receivers, thus removing an important damage prevention feature of the nozzles.

From the foregoing discussion, it should be apparent that a need exists for an apparatus, system, and method that allows the pressure sensing component to be removed and replaced modularly on site. Beneficially, such an apparatus, system, and method would also allow the end user to repair, set, and calibrate the module, obviating the need for use of a rebuild center. A need also exists for a related apparatus, system, and method to protect the end of the nozzle when the nozzle is not in use. Beneficially, such an apparatus, system, and method, would be adaptable to various diameter restrictions of the fuel receiver.

SUMMARY OF THE INVENTION

The present invention has been developed in response to the present state of the art, and in particular, in response to the problems and needs in the art that have not yet been fully solved by currently available fuel nozzles. Accordingly, the present invention has been developed to provide an apparatus, system, and method for a pressure sensing component that can be removed and repaired on site, and that thus overcomes many or all of the above-discussed shortcomings in the art.

This allows an end user, for example a mine site, to quickly rebuild worn nozzles without sending the entire unit to a dedicated rebuild center. This not only saves direct costs associated with shipping and handling but also provides an increased safety margin in that a fuel soaked nozzle is not shipped to another facility. End users see a significant savings in rebuild costs by rebuilding the nozzles so quickly within their own facilities and without the need for specialized tools or calibration devices.

The modular backpressure sensor essentially comprises a pressure sensing chamber defined by a modular housing. The pressure sensing chamber is configured to communicate with the fluid flow channel of the fluid delivery nozzle and is equipped with a pressure sensing device or material. The pressure response member responds to pressure within the fluid flow channel of the nozzle by activating the shut-off valve within the fluid delivery nozzle. A biasing member reacts to pressure on the pressure response member. A retainer retains either or both of the biasing member and the pressure response member within the modular housing.

The modular backpressure sensor is configured to removably engage a fluid delivery nozzle having a body with an outlet configured to engage a fluid storage tank connector and an inlet configured to engage a fluid delivery hose. A flow channel within the fluid delivery nozzle permits fluid flow from the inlet to the outlet and is configured to accommodate a shut-off valve. The shut-off valve is configured to cooperate with a stopper configured to block the flow of fluid through the valve. The fluid delivery nozzle comprises an interface configured to engage the modular backpressure sensor and to communicate backpressure to the modular backpressure sensor.

Together the modular backpressure sensor and associated fluid delivery nozzle comprise a system for delivering fluid to a receptacle. The fluid delivery nozzle is configured to removably engage the modular backpressure sensor. The fluid delivery nozzle body has an outlet configured to engage a fluid receiving tank connection and an inlet configured to engage a fluid conductor such as a hose. A flow channel in the fluid delivery nozzle body permits fluid flow from the inlet to the outlet. The flow channel includes a shut-off valve configured to block the flow of fluid through the flow channel. The fluid delivery system also includes a fluid receiving tank connection which may engage the fluid outlet of the fluid delivery nozzle and a fluid conductor with a nozzle connection which may engage the fluid inlet of the fluid delivery nozzle.

The present invention also includes a modular backpressure sensor kit for maintaining a fluid delivery nozzle having a modular backpressure sensor. The kit may include at least one modular backpressure sensor calibrated to operate in cooperation with the fluid delivery nozzle and optionally may include other maintenance and repair elements such as tools, replacement sealing rings, replacement bushings, and replacement snap rings.

A means for a sensing fluid backpressure from a fluid receptacle is disclosed. The means comprises modular means for sensing fluid backpressure, means for removably connecting the modular means for sensing fluid backpressure to a fluid delivery nozzle, means for communicating fluid back pressure within a fluid flow channel of the fluid delivery nozzle to the modular means for sensing fluid backpressure, means for generating a backpressure response within the modular means for sensing fluid backpressure and means for communicating the generated backpressure response to a shut-off valve within the fluid flow channel.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Many of the functional units described in this specification have been labeled as modules, in order to more particularly emphasize their implementation independence.

Furthermore, the described features, structures, or characteristics of the invention may be combined in any suitable manner in one or more embodiments. In the following description, numerous specific details are provided to facilitate a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
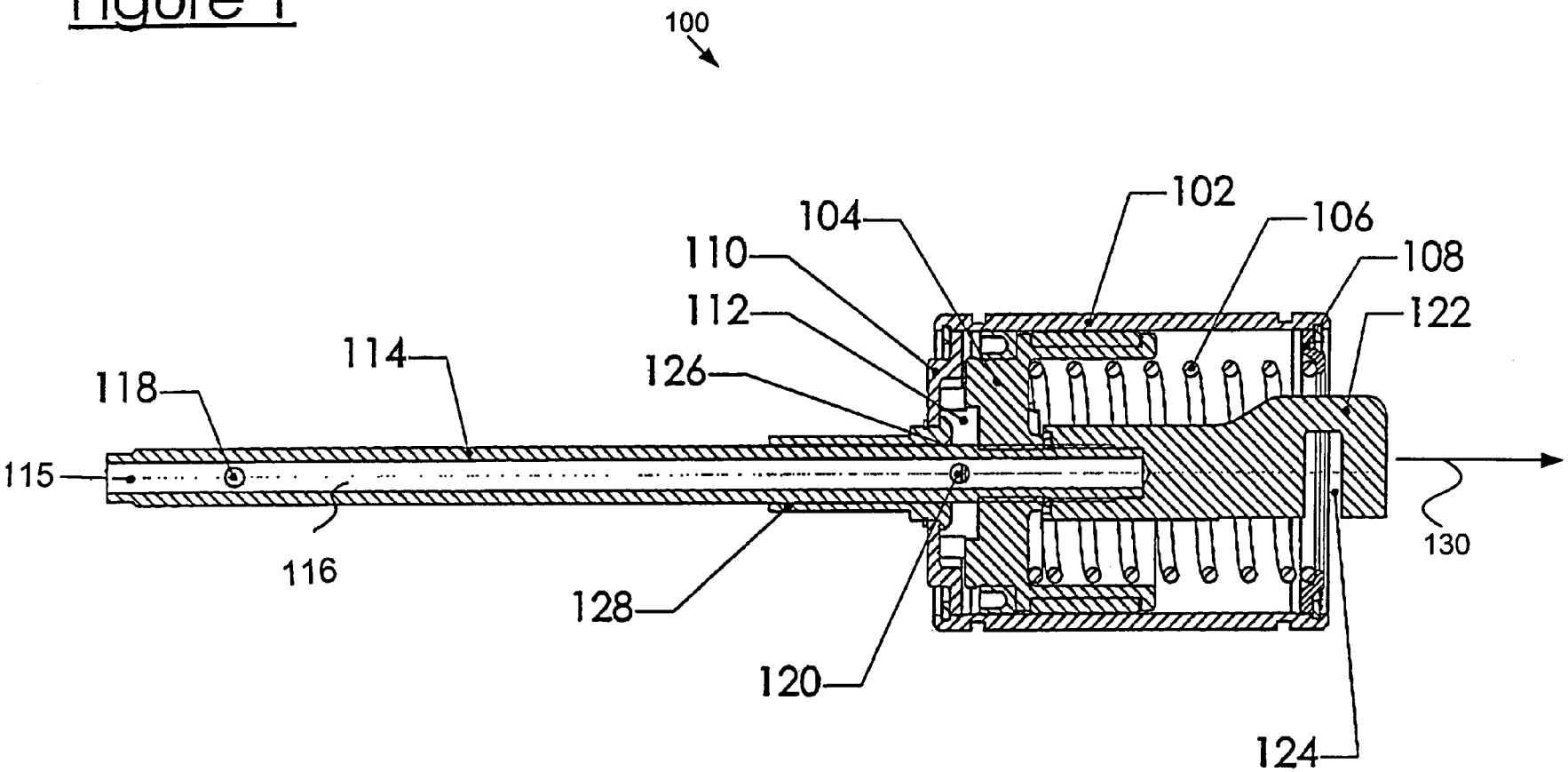
FIG. 1 is a cross-section diagram illustrating a lateral section of one embodiment of an assembled modular backpressure sensor.

FIG. 1 is a cross-section diagram of one embodiment of an assembled modular backpressure sensor 100. As depicted, the modular backpressure sensor 100 comprises a modular housing 102, a backpressure piston 104, a piston spring 106, a piston spring retainer 108, a housing head 110, a fluid pressure chamber 112, a piston rod 114, a longitudinal bore 116, a forward radial bore 118, a fluid pressure chamber radial bore 120, a backpressure piston extension 122, a lateral groove 124, a housing head aperture 126, and a bushing 128.

The modular housing 102 contains the backpressure piston 104 and the piston spring 106. The backpressure piston 104 forms a fluid impermeable seal with the walls of the modular housing 102. The piston spring retainer 108 confines the piston spring 106 within the modular housing 102. The housing head 110 seals the forward end of the modular housing 102 and cooperates with a wall of the modular housing 102 and the piston 104 to define the fluid pressure chamber 112 between the backpressure piston 104 and the housing head 110. As depicted, the modular housing 102 has a circular cross-section. In alternative embodiments, the modular housing 102 may have an elliptical or other non-circular cross-section.

In the illustrated embodiment the piston rod 114 passes through the cylinder head aperture 126 and connects to the backpressure piston 104. The bushing 128 aligns the piston rod 114 with a longitudinal axis 115 of the modular housing 102. Fluid enters the piston rod 114 through the forward radial bore 118 and flows through the longitudinal bore 116 and enters the fluid pressure chamber 112 through the fluid pressure chamber radial bore 120. The flowing fluid fills the fluid pressure chamber 112 and the pressure moving the fluid begins to build in the fluid pressure chamber. Alternatively, a flexible diaphragm in the housing head 110 may transfer pressure from a fluid in the piston rod 114 to a fluid such as a gas within the fluid pressure chamber 112. In yet another embodiment, the pressure of the fluid in the piston rod 114 is registered by an electronic pressure sensor in communication with the fluid flowing in the piston rod 114.

Increasing pressure within the fluid pressure chamber 112 drives the backpressure piston 104 back against the resistance of the piston spring 106. In a further embodiment, a compressible solid, gas, liquid, or other resilient material may be used in place of the piston spring 106 to provide resistance.

The movement of the backpressure piston 104 retracts the piston rod 114 in direction 130. The piston extension 122, with its lateral groove 124 serves as an attachment site for an activation handle (See FIG. 3).

Figure 2:
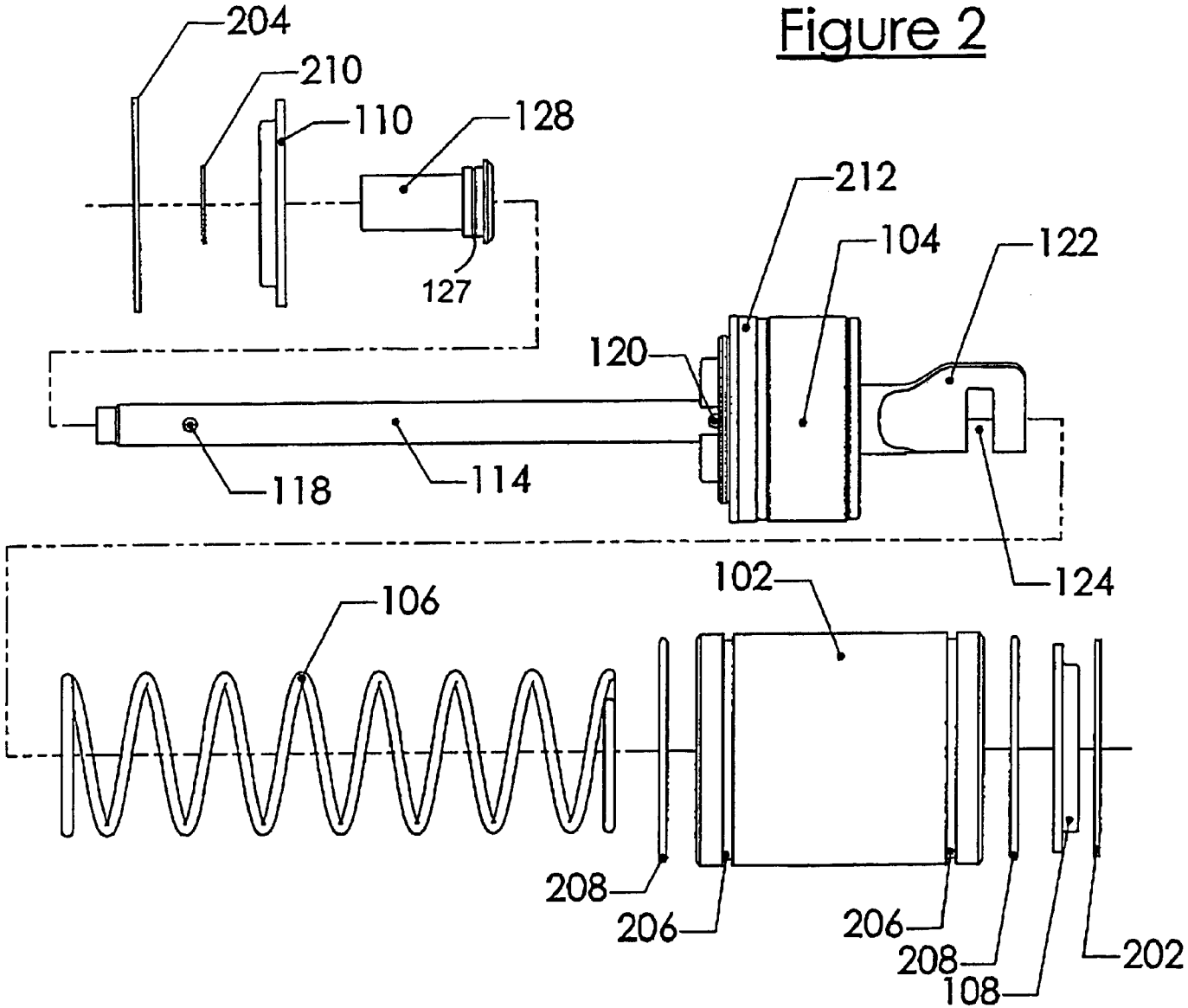
FIG. 2 is an exploded view of one embodiment of a modular backpressure sensor.

FIG. 2 is an exploded view of the modular backpressure sensor 100 illustrated in FIG. 1. As depicted, in addition to the parts identified in FIG. 1, the modular backpressure sensor 100 comprises snap rings 202 and 204, O-ring channels 206, O-rings 208, bushing snap ring 210, and backpressure piston seal 212.

In the depicted embodiment snap ring 202 engages an interior channel in the modular housing 102 and secures the piston spring retainer 108. Snap ring 204 engages an interior channel in the modular housing 102 and secures the housing head 110. The snap rings 202, 204 prevent internal components within the housing 102 from escaping in response to the forces imposed by the spring 106 and fluid force within the fluid pressure chamber 112. The O-ring channels 206 receive and retain the O-rings 208. The O-rings 208 retain the modular housing 102 within an opening within a fluid nozzle. The bushing snap ring 210 engages a channel 127 in the bushing 128. The bushing snap ring 210 secures the bushing 128 to the housing head 110. The backpressure piston 104 incorporates an annular channel to accept a backpressure piston seal 212 that forms a fluid impermeable seal with the interior wall of the modular housing 102 such that fluid is retained within the fluid pressure chamber 112.

In an alternative embodiment, the housing head 110 may be formed as an integral part of the modular housing 102. Additionally, the housing head 110 maybe formed as a cap that attaches to the modular housing body by means of threads, grooves, flanges, clips, or other fastening means. In another embodiment, the piston spring retainer 108 may be formed as an integral part of the modular housing 110. The piston spring 106 may be removed from the modular housing 110 through an opening configured to accommodate a removable housing head 110. The piston spring retainer 108 may also be formed as a cap that attaches to the modular housing body by means of threads, grooves, flanges, clips, or other fastening means. In embodiments with an integrated housing head 110 or piston spring retainer 108, snap rings 202 or 204 may not be required.

Figure 3:
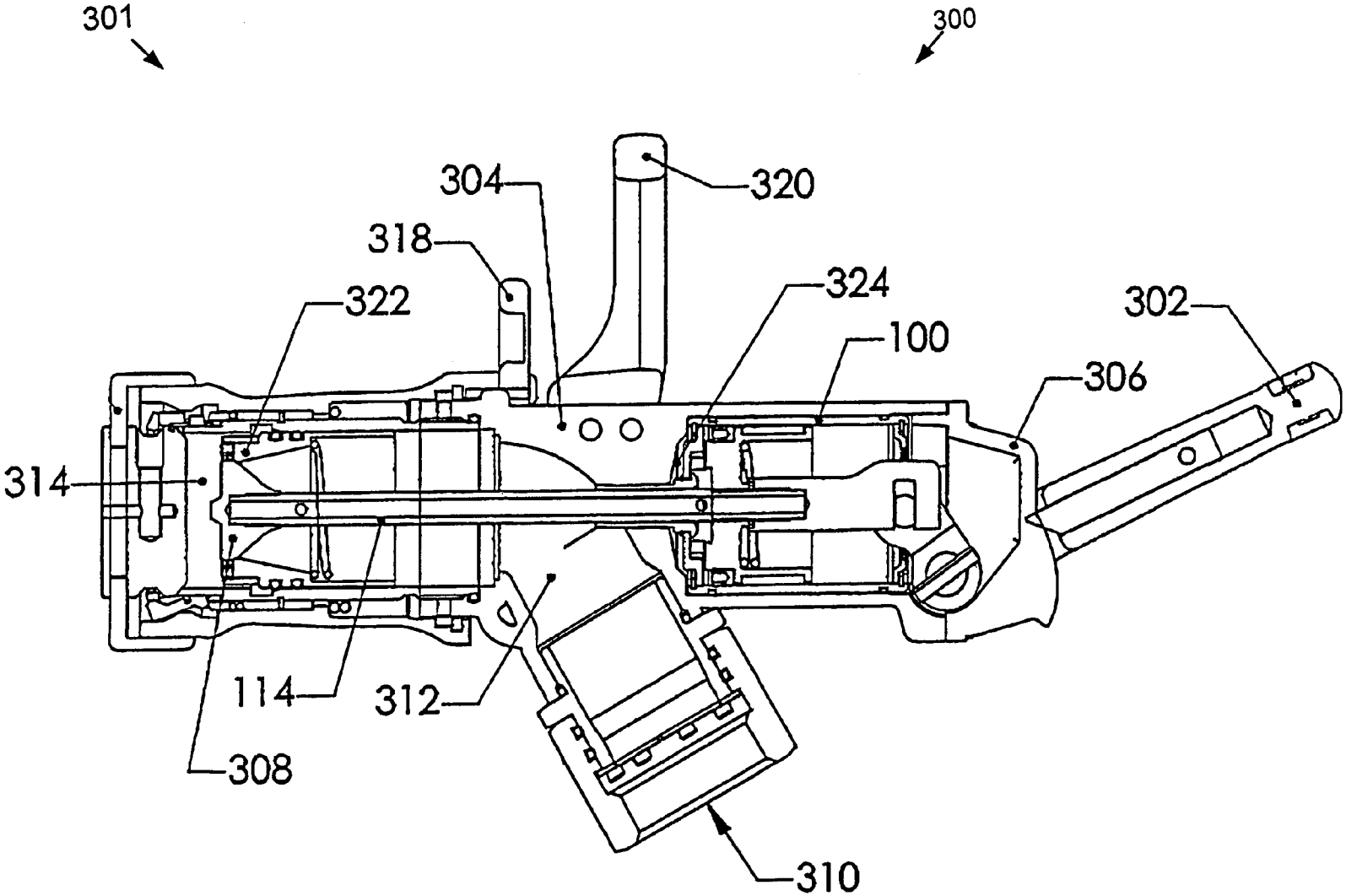
FIG. 3 is a perspective cross-section diagram illustrating a fluid delivery nozzle with a modular backpressure sensor installed in accordance with one embodiment of the present invention.

FIG. 3 is a cross-section diagram illustrating one embodiment of a combined fluid delivery apparatus 300 comprising a fluid delivery nozzle 301 configured to receive a modular backpressure sensor 100. As depicted, the combined apparatus 300 comprises a modular backpressure sensor 100, an actuator handle 302, a nozzle body 304, a removable back plate 306, a piston rod 114, a sealing poppet 308, a fluid intake port 310, a fluid flow channel 312, a fluid outlet port 314, a pull-back handle 318, a carry handle 320, a fluid shut-off valve 322 and a nozzle pressure cavity 324.

In operation, the fluid intake port 310 connects to a fluid conductor hose. The pull back handle 318 cocks the fluid outlet port 314 for connection to a receptacle connector. The carry handle 320 facilitates transport of the nozzle 301.

The activator handle 302 cooperates with the modular backpressure sensor 100 to extend the piston rod 114, pushing the sealing poppet 308 forward to open the fluid shut-off valve 322. The removable back plate 306 detaches to allow withdrawal of the modular backpressure sensor 100 from the nozzle pressure cavity 324.

The back plate 306 may be removed with standard tools, permitting access to the modular backpressure sensor 100. Preferably, the back plate 306 is secured to the nozzle 301 by way of common fasteners such as screws, nuts, thumbscrews, thumb-nuts, or the like.

The sealing poppet 308 may also be removed using standard tools such as needle nose pliers, a screw driver, or, alternatively, a poppet spanner wrench. When the back plate 306 and poppet 308 have been removed, the modular backpressure sensor 100 can be withdrawn from the rear of the nozzle body 301. The modular housing 102, the housing head 110, and the piston spring retainer 108 are preferably made of rigid, fluid insoluble, materials of sufficient size and thickness to withstand the pressure exerted by the piston spring 106 and by fluid within the pressure sensing chamber 112. In one embodiment, the modular housing 102, the housing head 110, and the piston spring retainer 108 are made of hard plastic, aluminum, stainless steel, or the like.

The robust nature of the modular housing 102, the housing head 110 and the piston spring retainer 108 facilitate the modular nature of the modular backpressure sensor 100. Moreover, the modular backpressure sensor 100 can be safely and conveniently removed and replaced. In standard existing fluid delivery nozzles, the piston spring sits directly within the nozzle backpressure chamber and is retained by a back plate. However, the back plate must be removed using specialized tools. Due to the bias forces within the spring of conventional fluid delivery nozzles, removal of the back plate without the special tools can cause the piston spring to violently ejects from the nozzle body creating a risk of potentially serious injury, especially to the eyes and face of a user.

Alternatively, the fluid delivery nozzle 301 may lack a nozzle pressure cavity 324 and the modular backpressure sensor 100 may engage the fluid delivery nozzle 301 directly, with the modular housing 102 exposed. Additionally, the modular backpressure sensor 100 may be connected to substantially any external surface of the fluid delivery nozzle 301.

In a further embodiment the modular backpressure sensor 100 may incorporate electronic, digital, or analog elements to supplement or replace the mechanical elements. In such an embodiment the modular backpressure sensor 100 may interact with the fluid delivery nozzle 301 through a sensing and communication element and may directly connect to the fluid delivery nozzle 301 or reside in a remote location. Such an embodiment would include a power source, an electronic modular backpressure sensor, and a shut-off switch. The shut-off switch may be configured to trigger an electronic or mechanical shut-off mechanism within the fluid delivery nozzle.

Figure 4:
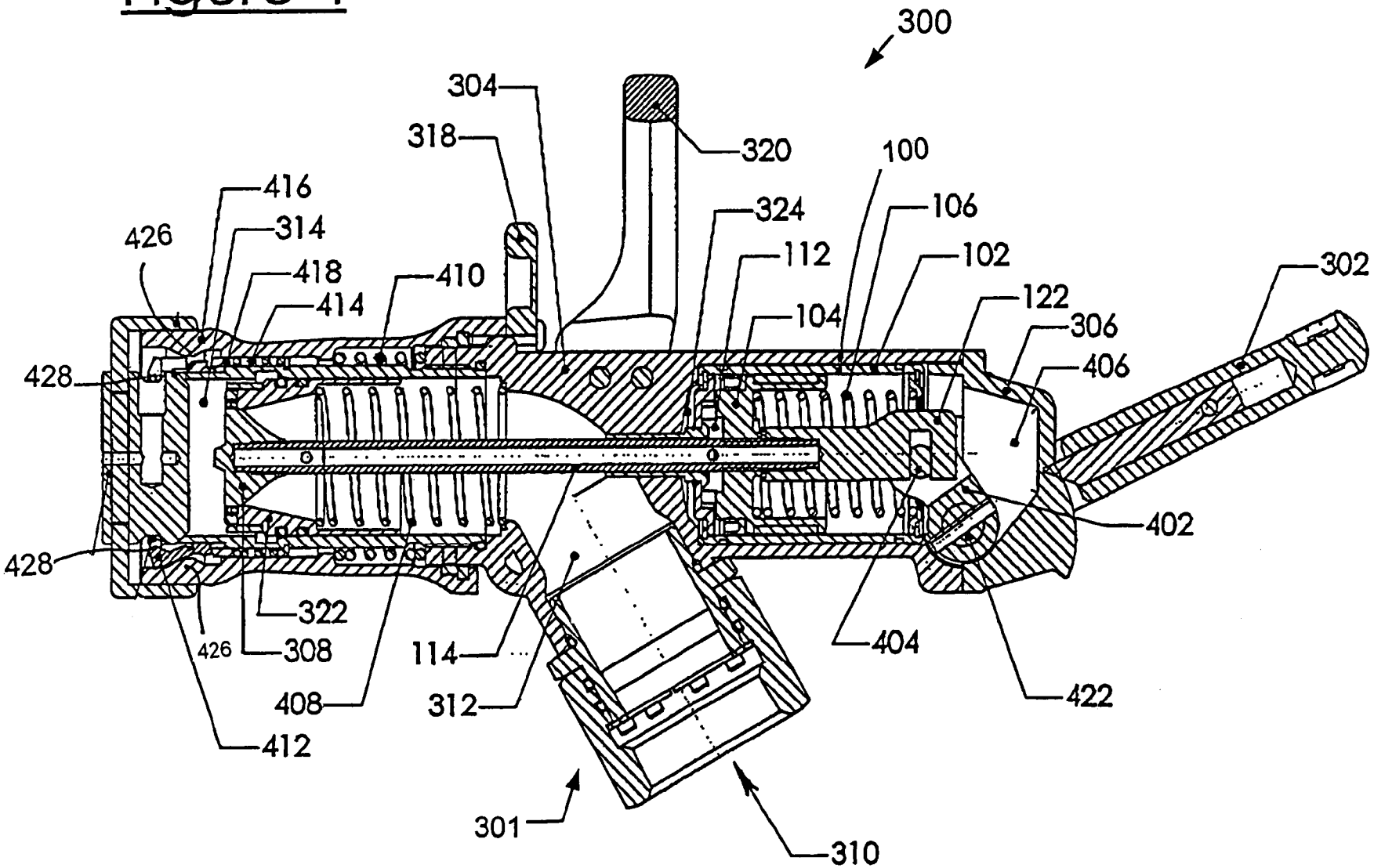
FIG. 4 is a schematic cross-section diagram illustrating a fluid delivery nozzle with a modular backpressure sensor installed in accordance with one embodiment of the present invention.

FIG. 4 is a cross-section diagram illustrating a lateral section of one embodiment of a combined fluid delivery apparatus 300. As depicted, the combined apparatus 300 comprises a fluid delivery nozzle 301, a modular backpressure sensor 100, a cam 402, a piston pin 404, a cam cavity 406, a valve spring 408, a pull-back spring 410, a release dog 412, a sleeve spring 414, a pull-back sleeve 416, a dog ring 418, an axle 422, a nub 426, and a tooth 428.

The pull-back handle 318 cocks the nozzle 301 for attachment to a receptacle connector (not shown). Cocking the nozzle 301 prepares the nozzle 301 for engaging the receptacle connector. Pulling back on the pull-back handle 318 moves the attached pullback sleeve 416 toward the rear of the nozzle 301. Backward movement of the pullback sleeve 416 releases the release dogs 412 that extend around the inner circumference of the fluid outlet port 314 of the nozzle body. A nub 426 on the inside wall of the pullback sleeve 416 slides along a release dog 412 and forces the release dog 412 to pivot and extend a tooth 428 of the release dog 412. The release dogs 412 open to increase the effective diameter between release dogs 412. The pull-back motion of the pullback sleeve 416 biases the sleeve spring 414 which facilitates return of the pull-back sleeve 416.

Once, the nozzle 301 is inserted into a receptacle connector, the pull-back handle 318 is moved forward with assistance from the pull-back spring 410. The nub 428 forces the release dogs 412 to close causing the release dogs 412 to clamp down on the receptacle connector and engage the receptacle connector. The dog ring 418 locates the release dogs 412 in either an open when the pull-back handle 318 is moved backward and in a closed position when the pull-back handle 318 is moved forward. Cocking the pull-back handle 318 locks the release dogs 412 in open position, allowing the nozzle 300 to be attached to or removed from a receptacle connector.

The activator handle 302 turns on axle 422 which in turn actuates cam 402 within cam chamber 406, exerting pressure on the piston pin 404 and on the backpressure piston extension 122. Moving the activator handle 302 to pivot in a counter-clockwise direction about the cam 402 allows the piston spring 106 to move the backpressure piston extension 122, the backpressure piston 104, the piston rod 114 and associated poppet 308 forward, opening the fluid shut-off valve 322. The fluid shut-off valve 322 is pressed against the valve spring 408 into a retracted position by the receptacle connector to which the nozzle 301 is attached for operation. Therefore, removal of the receptacle connector closes the valve spring 408.

Downward pressure on the activator handle 302 retracts the piston extension 122 and its associated structures including the poppet 308. This allows the poppet 308 to seal against the fluid shut-off valve 322 which in turn stops fluid flow through the nozzle. Such downward pressure causes the activator handle 302 to pivot in a counter-clockwise direction about the cam 402 and retracts the piston extension 122 and the poppet 308 to close the fluid shut-off valve 322.

Downward pressure on the activator handle 302 retracts the piston extension 122 and its associated structures including the poppet 308. FIG. 4 also illustrates the cross-section shape of the piston pin 404. In particular the piston pin 404 includes two opposing flattened edges 430. These edges 430, together with linkage 432 translate the rotational movement of the handle 302 about the cam 402 into lateral movement to move the poppet 308.

Figure 5:
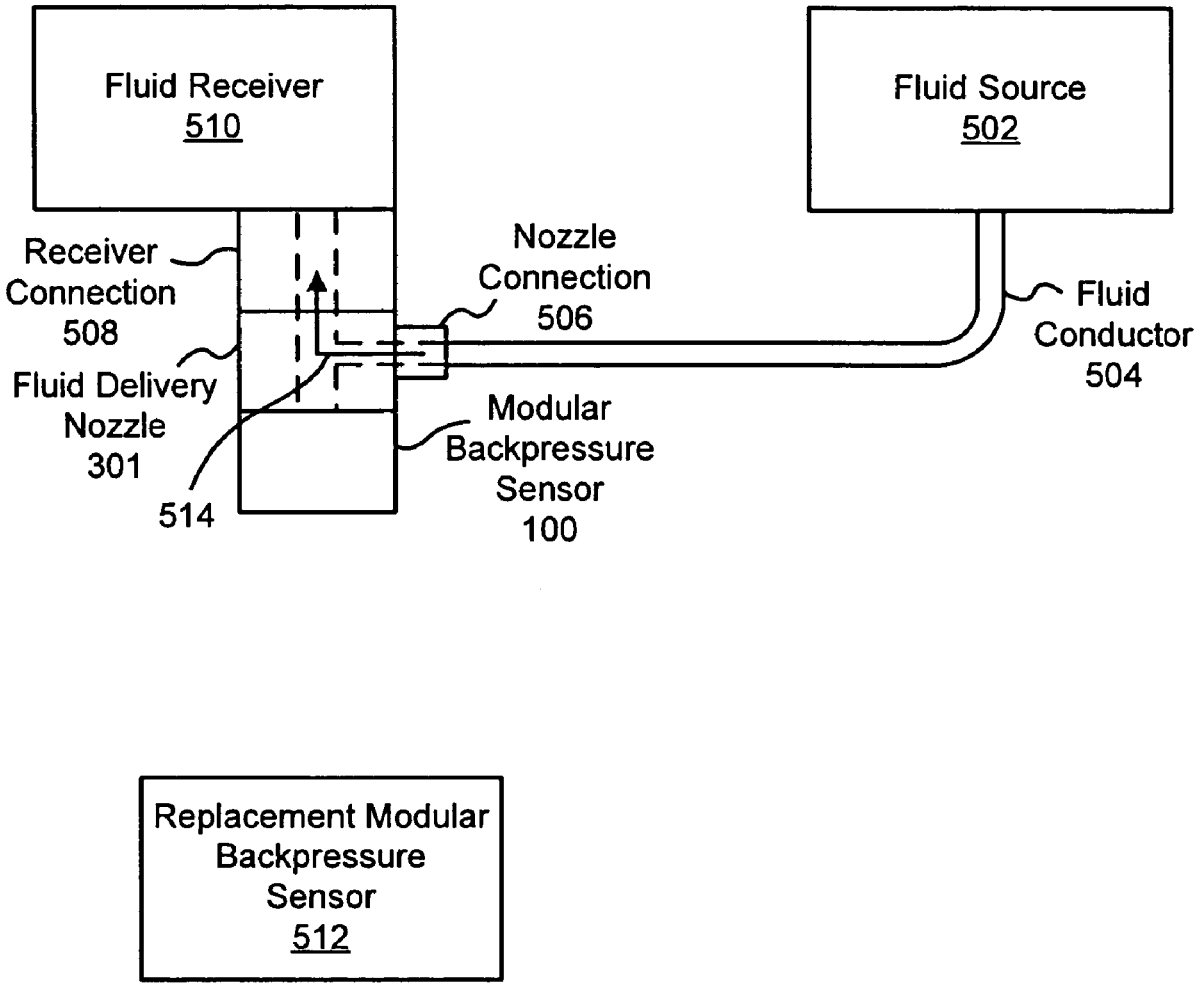
FIG. 5 is a schematic block diagram illustrating one embodiment of a system for fluid delivery using a modular backpressure sensor.

FIG. 5 is a schematic block diagram illustrating one embodiment of a system 500 for fluid delivery using a modular backpressure sensor. As depicted, the system 500 comprises a fluid source 502, a fluid conductor 504, a nozzle connection 506, a fluid delivery nozzle 301, a modular backpressure sensor 100, a receiver connection 508, a fluid receiver 510, and a replacement modular backpressure sensor 512.

The fluid source 502 may be a fuel, oil, water, or other fluid storage tank. In addition, the fluid in the fluid source 502 may comprise a material in a liquid, gas, or semi-solid state. The fluid conductor 504 transfers the fluid from the fluid source 502 to the nozzle connection 506. The fluid conductor 504 may be a hose, conduit, pipe, or other conducting apparatus.

The fluid delivery nozzle 301 and associated modular backpressure sensor 100 (discussed above) are removably connected or coupled to the fluid conductor 504 by way of the nozzle connection 506. The nozzle connection 506 may be fixed to the fluid conductor 504.

The receiver connection 508 may be fixed or removably connected to the fluid receiver 510. The fluid delivery nozzle 301 starts and stops fluid delivery to the fluid receiver 510. The modular backpressure sensor 100 cooperates with the fluid delivery nozzle 301 to automatically shut-off fluid flow in response to detected back pressure in the fluid delivery nozzle 301. Consequently, the modular backpressure sensor 100 is in fluid communication with the fluid flow path 514 such that the backpressure is detectable. Preferably, the modular backpressure sensor 100 is removably connectable to the fluid flow path 514. In certain embodiments, the modular backpressure sensor 100 is in mechanical communication with the fluid delivery nozzle 301 in order to activate a mechanical shut-off valve 322. Alternatively, the modular backpressure sensor 100 may send an electrical signal that activates an electronic shut-off valve in the fluid delivery nozzle 301.

Advantageously, the modular backpressure sensor 100 can be readily removed using common tools including a Phillips screw driver, a crescent wrench, or the like. Consequently, when an operator determines that the modular backpressure sensor 100 should be rebuilt due to wear of the spring 106, a certain number of uses, or passage of a certain amount of time, the modular backpressure sensor 100 can be readily replaced by the replacement modular backpressure sensor 512. Alternatively, the modular backpressure sensor 100 may be removed, rebuilt on site, and reinstalled. On site rebuilding of the modular backpressure sensor 100 may be accomplished using additional tools such as snap-ring pliers, needle nose pliers.

The piston spring 106, O-rings 208, and the piston ring 212 comprise the principle points of wear on the modular backpressure sensor. Pre-calibrated springs are available for various levels of shut-off pressure. Therefore, rebuilding of the depicted embodiment of the modular backpressure sensor 100 would usually comprise removal of the snap ring 202, the piston spring retainer 208, and the piston spring 106, and replacement of the piston spring 106 with a new, pre-calibrated spring 106. New snap rings 202, 204 may be installed. The snap rings 202, 204 may serve as a replacement fastener. Additionally, the piston 104 may be removed for seating of a new sealing ring within the piston channel 212 and the external modular housing O-rings 208 may be replaced.

The piston spring retainer 108 and snap ring 202 would then be reinserted into the modular housing 110 and the modular backpressure sensor 100 reengaged with the nozzle body 301. The poppet 308 would be reinstalled on the piston rod 114, the activation handle 302 reengaged with the piston extension 122 by means of the piston pin 404 and the back plate 306 reattached.

Figure 6:
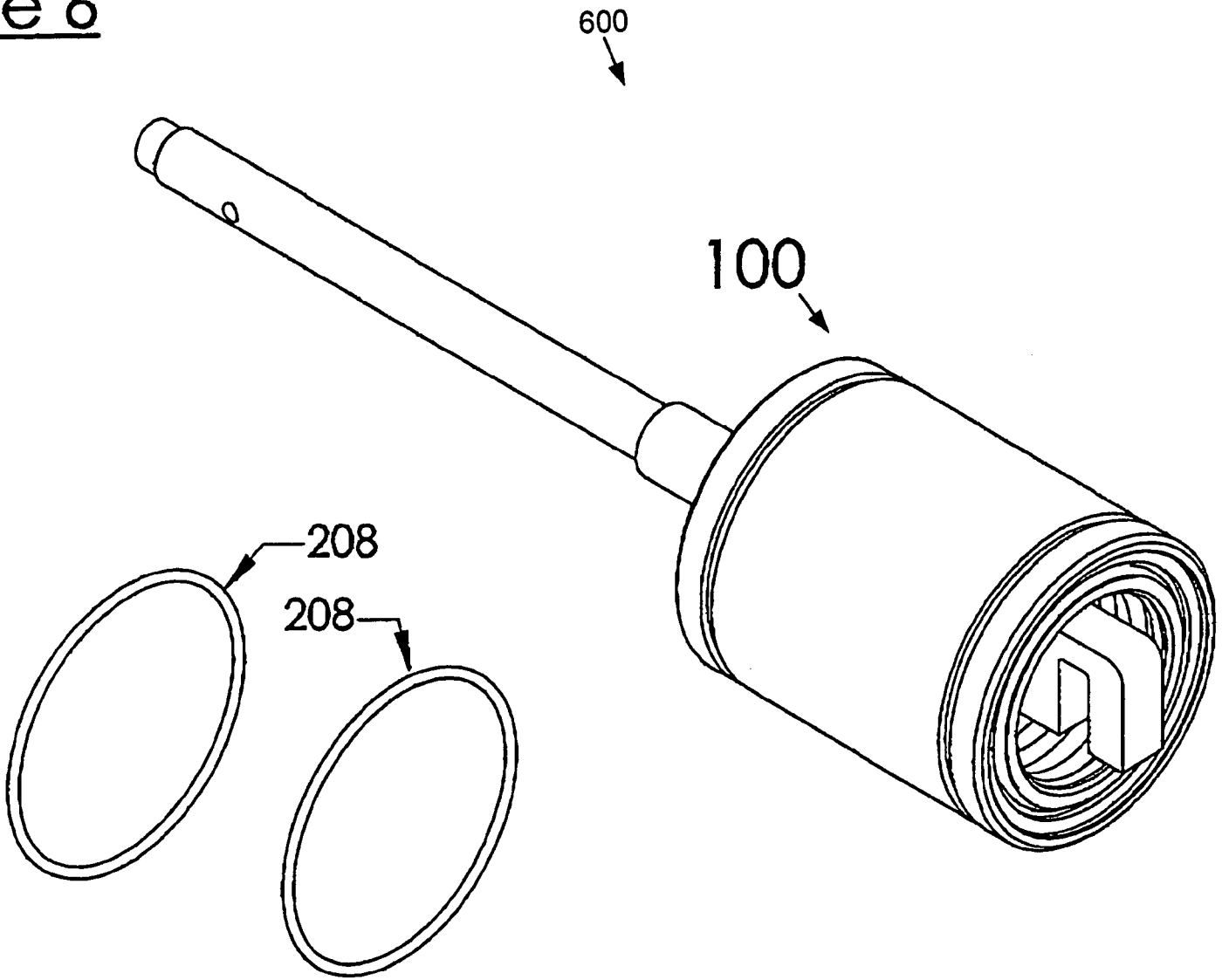
FIG. 6 is a schematic block diagram illustrating one embodiment of a modular backpressure sensor kit.

FIG. 6 is a block diagram illustrating one embodiment of modular backpressure sensor kit 600. A typical kit 600 could include a pre-calibrated modular backpressure sensor unit 100 and associated seals 208 required for installation of the modular backpressure unit. The associated seals 208 may comprise rubber or plastic O-rings or may comprise the piston seal 212. In another embodiment, the kit 600 may include several pre-calibrated modular backpressure sensor units 100 each calibrated for different backpressure levels.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular backpressure sensor comprising:

a modular housing configured to removably engage a fluid delivery nozzle, the modular housing defining a pressure sensing chamber configured to communicate with a fluid flow channel within the fluid delivery nozzle;

a pressure response member situated within the modular housing and configured to communicate with a flow shut-off valve within the fluid delivery nozzle;

a biasing member situated within the modular housing and configured to react to pressure on the pressure response member; and a retainer configured to retain at least one of the biasing member and the pressure response member within the modular housing; and an interface of the modular housing configured to engage the fluid delivery nozzle and to communicate backpressure to the modular housing, wherein the interface comprises attachment means configured to engage corresponding attachment means on the fluid delivery nozzle and further comprises a pressure communication element configured to communicate backpressure within the flow channel of the fluid delivery nozzle into the modular housing from within the flow channel of the fluid delivery nozzle.

2. The modular backpressure sensor of claim 1, wherein the pressure response member comprises a backpressure piston.

3. The modular backpressure sensor of claim 1, wherein the pressure response member and the biasing member comprise a single integrated module.

4. The modular backpressure sensor of claim 3, wherein the single integrated module is electronic.

5. The modular backpressure sensor of claim 1, wherein the retainer comprises a plate configured to further define the pressure sensing chamber within the housing and wherein the retainer further comprises a snap ring configured to engage a channel in an inner wall of the housing.

6. The modular backpressure sensor of claim 1, wherein the retainer comprises a cap configured to engage a wall of the housing by way of a fastener.

7. The modular backpressure sensor of claim 1, wherein the biasing member comprises a resilient material selected from the group consisting of a coil spring, a compressible gas, a compressible liquid, a compressible solid, and a combination thereof.

8. The modular backpressure sensor of claim 1, wherein the biasing member is pre-calibrated to satisfy at least one of flow rate and shut-off pressure specification.

9. The modular backpressure sensor of claim 2, further comprising a piston rod coupled to the backpressure piston, the piston rod configured to extend through an end of the modular housing to activate the shut-off valve in response to suitable backpressure in the pressure sensing chamber.

10. The modular backpressure sensor of claim 9, wherein the piston rod is further configured with a longitudinal bore and a radial bore in communication with the longitudinal bore near a forward end of the piston rod and a second radial bore in communication with the longitudinal bore within the pressure sensing chamber, the bores configured to conduct fluid from the fluid flow chamber into the pressure sensing chamber.

11. The modular backpressure sensor of claim 9, further comprising a stopper configured to removably connect to a free end of the piston rod and to engage a shut-off valve in the fluid flow channel of the delivery nozzle.

12. The modular backpressure sensor of claim 11, wherein stopper comprises a sealing poppet configured to removably engage the piston rod, the sealing poppet removable by way of a tool selected from the group consisting of pliers and a poppet spanner wrench.

13. The modular backpressure sensor of claim 2, wherein the backpressure piston further comprises an extension having a lateral groove open on one side, the extension configured to extend from the modular backpressure sensor in a direction opposite to the extension of the piston rod, the extension further configured to engage an activation handle attachment.

14. The modular backpressure sensor of claim 13, wherein the extension further comprises a two-pronged attachment fork configured to couple an activation handle to the extension, the prongs further comprising a distal, axial bore configured to receive a piston pin having a diameter greater than a width of the groove in the extension, the piston pin further comprising a flattened midsection having a diameter configured to slide into and non-rotatably engage the groove in the extension.

15. The modular backpressure sensor of claim 1, wherein the pressure response member comprises a diaphragm.

16. A modular backpressure sensor comprising:

a modular housing configured to removably engage a fluid delivery nozzle, the modular housing defining a pressure sensing chamber configured to communicate with a fluid flow channel within the fluid delivery nozzle;

a pressure response member situated within the modular housing and configured to communicate with a flow shut-off valve within the fluid delivery nozzle;

a biasing member situated within the modular housing and configured to react to pressure on the pressure response member;

a retainer configured to retain at least one of the biasing member and the pressure response member within the modular housing;

a body of the fluid delivery nozzle having an outlet configured to engage a fluid storage tank connector and an inlet configured to engage a fluid delivery hose, the flow channel situated within the body configured to permit fluid flow from the inlet to the outlet, the fluid flow channel further configured to accommodate the flow shut-off valve configured to cooperate with a stopper configured to block the flow of fluid through the valve; and an interface of the fluid delivery nozzle configured to engage the modular housing and to communicate backpressure to the modular housing, wherein the interface comprises attachment means configured to engage corresponding attachment means on the modular housing and further comprises a pressure communication element configured to communicate backpressure within the flow channel of the fluid delivery nozzle into the modular housing from within the flow channel of the fluid delivery nozzle.

17. The modular backpressure sensor of claim 16, wherein the pressure communication element comprises a piston rod configured to receive fluid within the flow channel and discharge the fluid within the modular housing.

18. The modular backpressure sensor of claim 16, wherein the pressure communication element is selected from the group consisting of an electronic sensor, a diaphragm, and a piston.

19. The modular backpressure sensor of claim 16, further comprising a back plate configured to securely retain the modular housing to the interface, within a sensor chamber, the back plate comprising removable fasteners that facilitate removal of the back plate and thereby removal of the modular housing.

20. The modular backpressure sensor of claim 19, wherein the back plate is further configured for removal and installation using standard tools selected from the group consisting of an allen wrench, a screwdriver, pliers, a socket wrench, a flat wrench, and a post wrench.

21. A system for delivering fluid to a receptacle, the system comprising:

a modular housing configured to removably engage a fluid delivery nozzle, the modular housing defining a pressure sensing chamber configured to communicate with a fluid flow channel within the fluid delivery nozzle;

a pressure response member situated within the modular housing and configured to communicate with a flow shut-off valve within the fluid delivery nozzle;

a biasing member situated within the modular housing and configured to react to pressure on the pressure response member;

a retainer configured to retain at least one of the biasing member and the pressure response member within the modular housing;

a body of the fluid delivery nozzle having an outlet configured to engage a fluid storage tank connector and an inlet configured to engage a fluid delivery hose, the fluid flow channel situated within the body configured to permit fluid flow from the inlet to the outlet, the fluid flow channel further configured to accommodate the flow shut-off valve configured to cooperate with a stopper configured to block the flow of fluid through the valve;

an interface of the fluid delivery nozzle configured to removably engage the modular housing and to communicate backpressure to the modular housing, wherein the interface comprises attachment means configured to engage corresponding attachment means on the modular housing and further comprises a pressure communication element configured to communicate backpressure within the flow channel of the fluid delivery nozzle into the modular housing from within the flow channel of the fluid delivery nozzle;

a fluid receiving tank connection connected with the outlet; and a fluid conductor having a nozzle connection connected with the inlet.

22. The system of claim 21, further comprising an activation handle configured to engage the modular housing and manipulate the flow shut-off valve within the fluid flow channel of the fluid delivery nozzle.

23. The system of claim 21, wherein the modular is configured to be removable using tools selected from the group consisting of an allen wrench, pliers, a screw driver, a socket wrench, a flat wrench, a post wrench, and a poppet spanner wrench.

24. The system of claim 21, further comprising a second modular housing pre-calibrated to replace the first modular housing.

25. A modular backpressure sensor kit for maintaining a modular backpressure sensor, the kit comprising:

at least one modular backpressure sensor calibrated to operate in cooperation with a fluid delivery nozzle, the modular backpressure sensor comprising:

a modular housing configured to removably engage the fluid delivery nozzle, the modular housing defining a pressure sensing chamber configured to communicate with a fluid flow channel within the fluid delivery nozzle;

a pressure response member situated within the modular housing and configured to communicate with a flow shut-off valve within the fluid delivery nozzle;

a biasing member situated within the modular housing and configured to react to pressure on the pressure response member;

a retainer configured to retain at least one of the biasing member and the pressure response member within the modular housing, wherein the modular backpressure sensor is an integral unit that is removable and engageable with the fluid delivery nozzle as a unit;

an interface of the modular housing configured to removably engage the modular housing of the modular backpressure sensor as a unit with the fluid delivery nozzle and to communicate backpressure to the modular housing from the fluid delivery nozzle, wherein the interface comprises an attachment mechanism configured to engage corresponding attachment mechanism on the fluid delivery nozzle and further comprises a pressure communication element configured to communicate backpressure within the flow channel of the fluid delivery nozzle into the modular housing from within the flow channel of the fluid delivery nozzle: and an associated seal required for installation of the modular backpressure sensor within the fluid delivery nozzle.

26. The kit of claim 25, further comprising a replacement fastener configured to secure the modular backpressure sensor to the fluid delivery nozzle.

* * * * *